US011591860B2

(12) United States Patent
Ren et al.

(10) Patent No.: US 11,591,860 B2
(45) Date of Patent: Feb. 28, 2023

(54) ROTARY STEERABLE DRILLING SYSTEM WITH ACTIVE STABILIZER

(71) Applicant: Baker Hughes Oilfield Operations LLC, Houston, TX (US)

(72) Inventors: Zhiguo Ren, Shanghai (CN); Xu Fu, Shanghai (CN); Stewart Blake Brazil, Niskayuna, NY (US); Chengbao Wang, Oklahoma City, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/186,075

(22) Filed: Feb. 26, 2021

(65) Prior Publication Data

US 2021/0254415 A1 Aug. 19, 2021

Related U.S. Application Data

(63) Continuation of application No. 16/476,174, filed as application No. PCT/US2018/012484 on Jan. 5, 2018, now abandoned.

(30) Foreign Application Priority Data

Jan. 5, 2017 (CN) ..... 201710007314.8

(51) Int. Cl.
*E21B 17/10* (2006.01)
*E21B 7/06* (2006.01)

(52) U.S. Cl.
CPC ..... *E21B 17/1021* (2013.01); *E21B 7/06* (2013.01); *E21B 17/10* (2013.01); *E21B 17/1078* (2013.01); *E21B 17/1014* (2013.01)

(58) Field of Classification Search
CPC ..... E21B 7/06; E21B 17/10; E21B 17/1028
See application file for complete search history.

(56) References Cited

U.S. PATENT DOCUMENTS 3,129,776 A * 4/1964 Mann ..... E21B 7/062 175/76
4,185,704 A * 1/1980 Nixon, Jr. ..... E21B 7/068 175/325.2

(Continued)

FOREIGN PATENT DOCUMENTS

WO 2013028490 A1 2/2013

OTHER PUBLICATIONS

Notification of Transmittal of the International Search Report and the Written Opinion of the International Searching Authority; PCT/US2018/012484; filed Jan. 5, 2018; dated May 23, 2018 (12 pages).

*Primary Examiner* — Robert E Fuller
*Assistant Examiner* — Lamia Quaim
(74) *Attorney, Agent, or Firm* — Cantor Colburn LLP

(57) ABSTRACT

A drilling system includes a drill string for connecting with a drill bit for drilling a borehole, a fixed stabilizer fixed on the drill string, and an active stabilizer including a body and actuators connecting the body and the drill string. The actuators are capable of driving the drill string away from a center of the borehole with a displacement. The body has an outer surface for contacting a wall of the borehole, an inner surface facing the drill string, and at least one guiding portion projecting from the inner surface and each defining at least one groove. The drill string includes at least one sliding portion slidable within the at least one groove respectively to constrain movement between the drill string and the active stabilizer along an axial direction of the drill string and guide movement between the drill string and the active stabilizer perpendicular to the axial direction.

11 Claims, 6 Drawing Sheets

(56) References Cited

U.S. PATENT DOCUMENTS

| | | | | |
|---|---|---|---|---|
| 4,394,881 | A * | 7/1983 | Shirley | E21B 7/062 166/319 |
| 5,265,684 | A | 11/1993 | Rosenhauch | |
| 6,290,002 | B1 | 9/2001 | Comeau et al. | |
| 6,318,481 | B1 * | 11/2001 | Schoeffler | E21B 7/062 175/73 |
| 6,328,119 | B1 | 12/2001 | Gillis et al. | |
| 7,650,952 | B2 | 1/2010 | Evans et al. | |

* cited by examiner

ROTARY STEERABLE DRILLING SYSTEM WITH ACTIVE STABILIZER

CROSS REFERENCE TO RELATED APPLICATIONS

This is a continuation of U.S. application Ser. No. 16/476,174 filed Jul. 5, 2019, which is a U.S. National Stage of Application No. PCT/US2018/012484, filed on Jan. 5, 2018, which claims the benefit of Chinese Patent Application No. 201710007314.8, filed on Jan. 5, 2017, the disclosures of which are incorporated herein by reference.

FIELD OF THE INVENTION

The present invention generally relates to a directional drilling system, and in particular, to a rotary steerable system with an active stabilizer.

BACKGROUND OF THE INVENTION

An oil or gas well often has a subsurface section that needs to be drilled directionally. Rotary steerable systems, also known as "RSS," are designed to drill directionally with continuous rotation from the surface, and can be used to drill a wellbore along an expected direction and trajectory by steering a drill string while it's being rotated. Thus rotary steerable systems are widely used in such as conventional directional wells, horizontal wells, branch wells, etc. Typically, there are two types of rotary steerable systems: "push-the-bit" systems and "point-the-bit" systems, wherein the push-the-bit system has a high build-up rate but forms an unsmooth drilling trajectory and rough well walls, whereas the point-the-bit system forms relatively smoother drilling trajectory and well walls, but has a relatively lower build-up rate.

The push-the-bit systems use the principle of applying a lateral force to the drill string to push the bit to deviate from the well center to change the drilling direction. The drilling qualities of the existing push-the-bit systems are much subjected to the conditions of well walls. Uneven formation and vibrations of the drill bit during the drilling may cause a rough well wall and an unsmooth drilling trajectory. Thus it is hard to achieve high steering precision. A rough well wall may lead difficulties in casing (well cementing), trip-in and trip-out operations. How to exactly drill a downhole along a desired trajectory with high quality while fully rotating the drill tool is always a challenge.

Accordingly, there is a need to provide a new rotary steerable system to solve at least one of the above-mentioned technical problems.

SUMMARY OF THE INVENTION

A drilling system includes a rotatable drill string for connecting with a drill bit for drilling a borehole, at least one fixed stabilizer fixed on the drill string, and an active stabilizer. The fixed stabilizer has an outer surface for contacting a wall of the borehole. The active stabilizer includes a body, and a plurality of actuators connecting the body and the drill string and capable of driving the drill string to deviate away from a center of the borehole with a displacement. The body has an outer surface for contacting a wall of the borehole, an inner surface facing the drill string, and at least one guiding portion projecting from the inner surface towards the drill string. Each guiding portion defines at least one groove. The drill string includes at least one sliding portion, each capable of sliding within one of the at least one groove defined in the body of the active stabilizer, to constrain relative movement between the drill string and the active stabilizer along an axial direction of the drill string and guide relative movement between the drill string and the active stabilizer along a radial direction substantially perpendicular to the axial direction of the drill string.

BRIEF DESCRIPTION OF THE DRAWINGS

The above and other aspects, features, and advantages of the present disclosure will become more apparent in light of the subsequent detailed description when taken in conjunction with the accompanying drawings in which.

DETAILED DESCRIPTION OF THE INVENTION

One or more embodiments of the present disclosure will be described below. Unless defined otherwise, technical and scientific terms used herein have the same meaning as is commonly understood by one of skill in the art to which this invention belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean any, some, or all of the listed items. The use of "including," "comprising" or "having" and variations thereof herein are meant to encompass the items listed thereafter and equivalents thereof as well as additional items. The term "coupled" or "connected" or the like is not limited to being connected physically or mechanically, but may be connected electrically, directly or indirectly.

Embodiments of the present disclosure relate to a rotary steerable system for directional drilling a borehole or wellbore. The rotary steerable system involves an active stabilizer and sliding mechanism. The active stabilizer includes a body that can contact a wall of the borehole, and a plurality of actuators that can be controlled to push a drill bit of the rotary steerable system to move against the body of the active stabilizer with the constraint of the sliding mechanism. When the body of the active stabilizer contacts the borehole wall, a lateral force is applied to the body of the active stabilizer to help the actuators to push the drill bit away from a center of the borehole and thereby change the drilling direction during the drilling.

Figure 1:
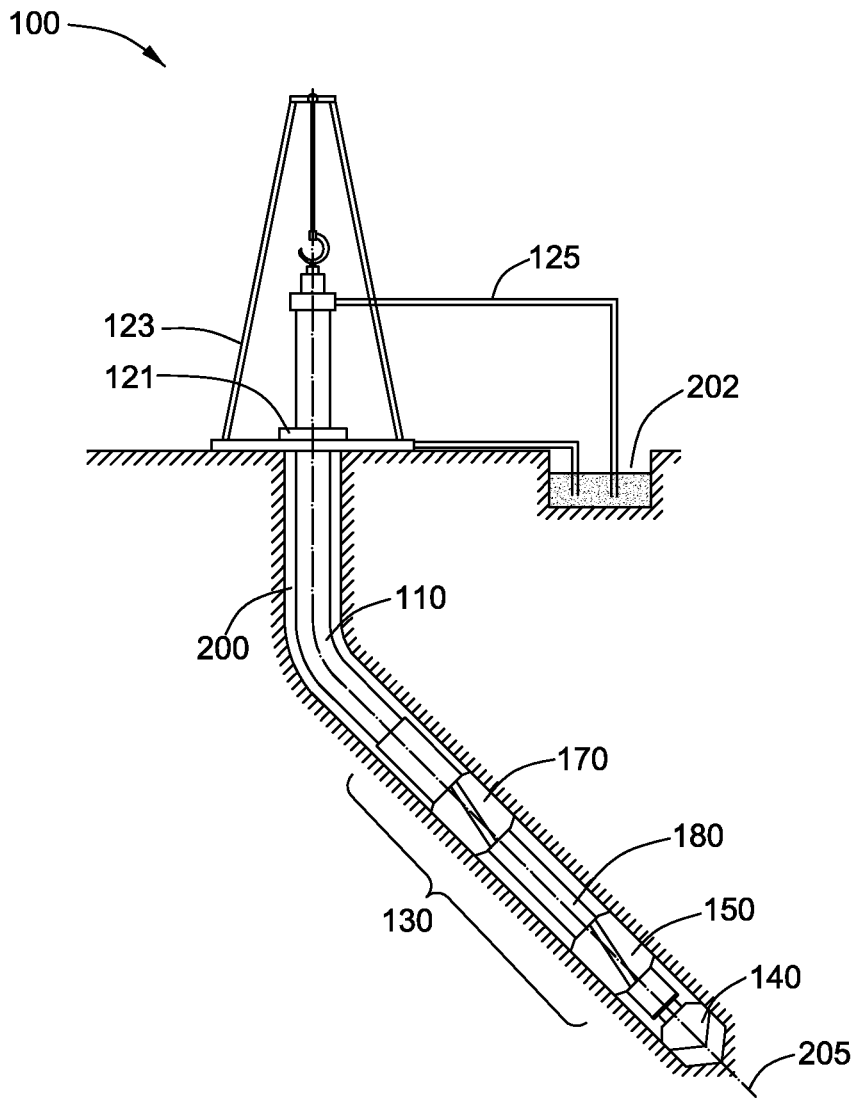
FIG. 1 is a schematic side view of a rotary steerable system including a drill string, a fixed stabilizer and an active stabilizer.

Referring to FIG. 1, a rotary steerable system 100 is used for directionally drilling a borehole 200 in the earth. The rotary steerable system 100 includes a drill string 110 rotatably driven by a rotary table 121 (or by top drive instead) from the surface and is coupled with a drill bit 140 at a distal end thereof. The drill bit 140 has cutting ability, and once is rotated, is able to cut and advance into the earth formation. The drill string 110 typically is tubular. A bottom hole assembly (BHA) 130 forms a down-hole near-end section of the drill string 110, which typically houses measurement control modules and/or other devices necessary for control of the rotary steerable system. The length of the drill string 110 can be increased as it progresses deeper into the earth formation, by connecting additional sections of drill string thereto.

In addition to the rotary table 121 for providing a motive force to rotate the drill string 110, the rotary steerable system 100 may further include a drilling rig 123 for supporting the drill string 110, and a mud tube 125 for transferring mud from a mud pool 202 to the drill string 110 by a mud pump (not shown). The mud may serve as a lubricating fluid and be repeatedly re-circulated from the mud pool 202, through the mud tube 125, the drill string 110 and the drill bit 140, under pressure, to the borehole 200, to take away cuttings (rock pieces) that are generated during the drilling back to the mud pool 202 for reuse after the cuttings are separated and removed from the mud by, such as filtration.

Figure 2:
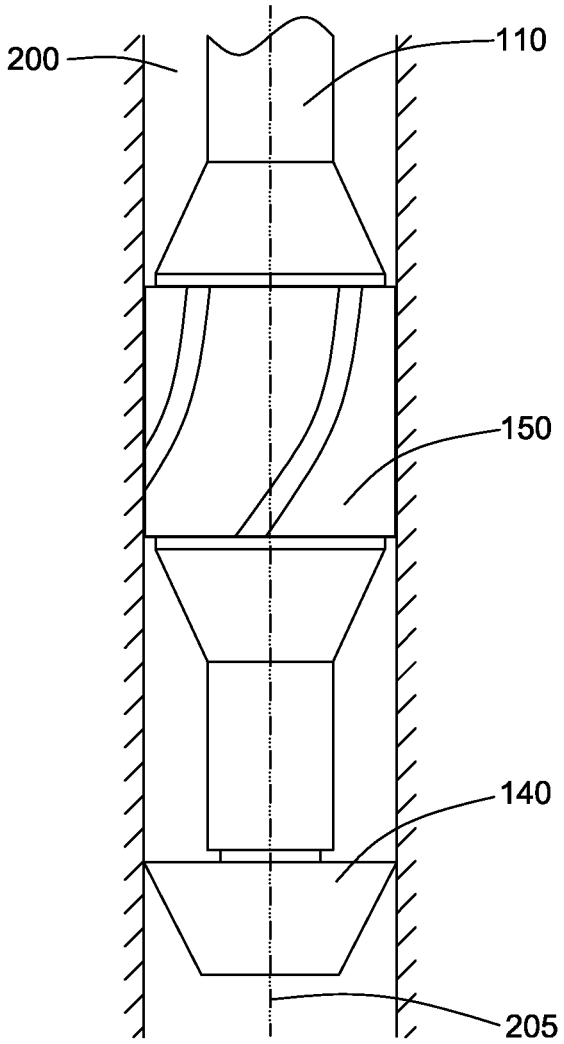
FIG. 2 illustrates a first position state of the active stabilizer and the drill string of FIG. 1.
Figure 3:
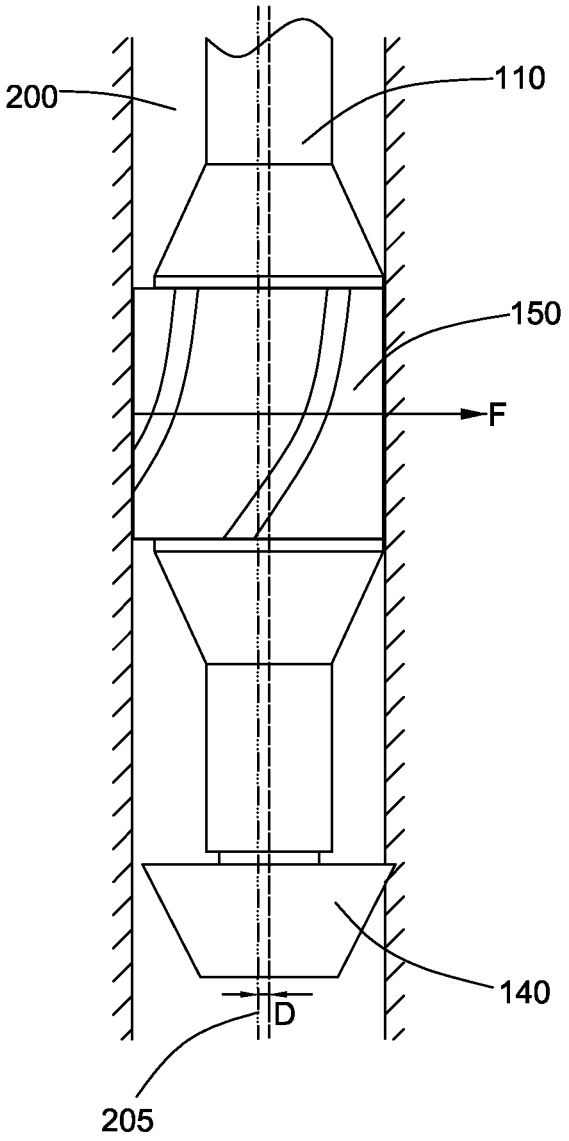
FIG. 3 illustrates a second position state of the active stabilizer and the drill string of FIG. 1.

In order to achieve directional control while drilling, the rotary steerable system 100 may include an active stabilizer 150, which is capable of stabilizing the drill string 110 against undesired radial shaking to keep the drill string 110 at the center of the borehole 200 when the drilling is along a straight direction, as well as driving the drill string 110 to deviate away from a center of the borehole 200 being drilled in order to change the drilling direction when it is needed to change the drilling direction during the drilling. As shown in FIG. 2, when the rotary steerable system is drilling along a straight direction, a center axis of the drill string 110 substantially coincides with a center axis 205 of the borehole 200 around the position of the active stabilizer 150, and an outer surface of the active stabilizer 150 contacts the inner surface of the borehole 200 to reduce or prevent undesired radial shaking. When it is needed to change the drilling direction while drilling, the active stabilizer 150 may push the drill string 110 to make the center axis of the drill string 110 around the position of the active stabilizer 150 deviate away from the borehole center with a desired displacement, and keep the displacement while the drill string 110 is rotating. As shown in FIG. 3, the active stabilizer 150 abuts on the inner surface of the borehole 200 to apply a lateral force F to the drill string 110 to push the drill string 100 to make the center axis of the drill string 110 around the position of the active stabilizer 150 deviate away from the center axis 205 of the borehole 200 with a desired displacement D along a desired direction.

During the drilling, there may be a continuous contact between the active stabilizer 150 and the inner surface of the borehole 200, and therefore the drill string 110 may be continuously pushed by the active stabilizer to deviate so as to change the drilling direction when it is needed. Moreover, there is less impact from borehole rugosity, and the active stabilizer 150 can also function as a general stabilizer for stabilizing the drill string 310 against undesired radial shaking during the drilling.

Returning to FIG. 1, the rotary steerable system 100 may further include one or more fixed stabilizers 170 fixed on the drill string 110. In some embodiments, the one or more fixed stabilizers are fixed to prevent relative movement between the stabilizers 170 and the drill string 110. In some embodiments, the one or more fixed stabilizers 170 are above the active stabilizer 150, i.e., farther away from the drill bit 140 at the distal end of the drill string 110, compared with the active stabilizer 150. The fixed stabilizer 170 has an outer surface for contacting a wall of the borehole 200, and can stabilize the drill string 110 against radial shaking during the drilling to keep the drill string 110 at the center of the borehole 200. In some embodiments, the fixed stabilizer 170 includes an annular structure having an outer diameter slightly smaller than the diameter of the borehole. The active stabilizer 150 and the nearest fixed stabilizer 170 may be connected through a slightly flexible structure 180, for example, a string section with a thinner wall comparing with other sections of the drill string 110. The string section between the two stabilizers may bend a little while changing the drilling direction, which may improve the built-up rate and smoothness of the drilling trajectory.

Figure 4:
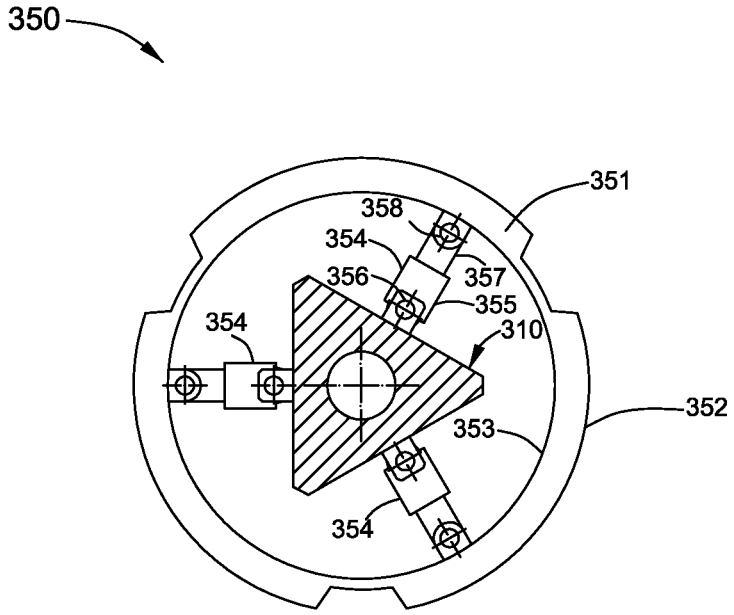
FIG. 4 is a schematic cross sectional view of an active stabilizer that can be used in a rotary steerable system like that of FIG. 1, in accordance with one embodiment of the present disclosure.
Figure 5:
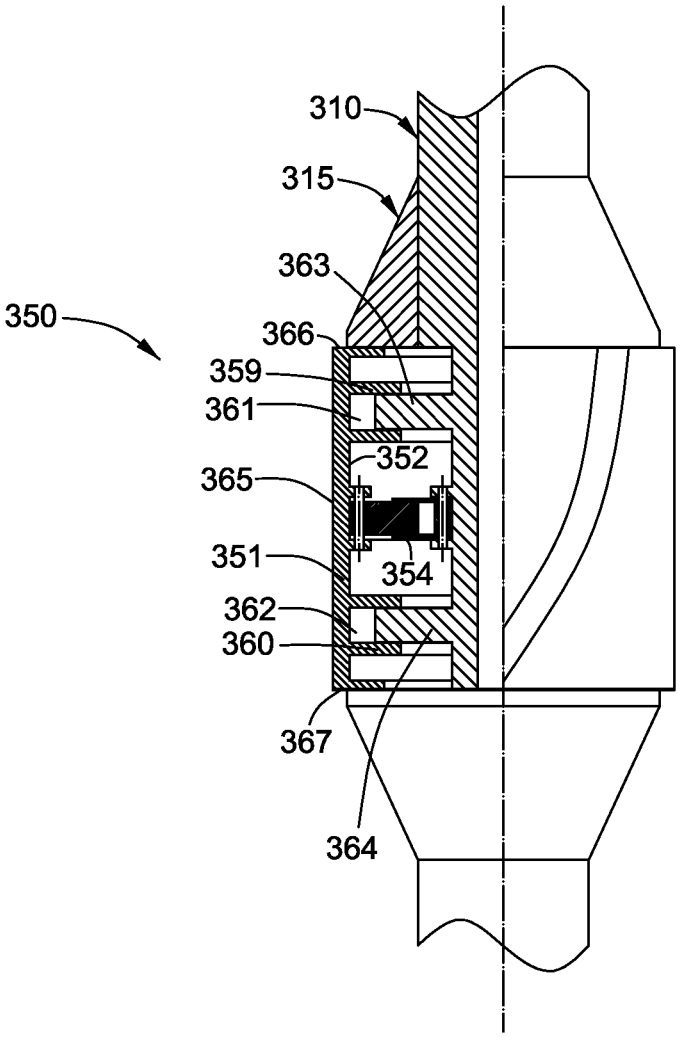
FIG. 5 is a partial longitudinal sectional view illustrating how the active stabilizer of FIG. 4 is coupled to a drill string.

FIGS. 4 and 5 illustrate an active stabilizer 350 that can be used in a rotary steerable system like the system 100 of FIG. 1. The active stabilizer 350 includes a body 351 having an outer surface 352 for contacting a wall of a borehole being drilled and an inner surface 353 facing a drill string 310. The active stabilizer 350 further includes a plurality of actuators 354 connecting the body 351 and the drill string 310. In the specific embodiment as illustrated in FIG. 4, there are three such actuators 354. Each of the actuators 354 includes a cylinder 355 rotatably coupled to one of the drill string 310 and the body 351 through a first pivot joint 356, and a piston 357 rotatably coupled to the other of the drill string 310 and the body 351 through a second pivot joint 358. The piston 357 is driven by a hydraulic system and is movable within the cylinder 355. Therefore, as for each actuator 354, the cylinder 355 is rotatable around the first pivot joint 356, the piston 357 is rotatable around the second pivot joint 358, and the piston 357 is movable within the cylinder 355. The plurality of actuators 354 are capable of driving the drill string 310 to deviate away from the borehole center with a displacement and stabilizing the drill string 310 against undesired radial shaking during the drilling.

The body 351 of the active stabilizer 350 further includes at least one guiding portion 359/360 projecting from the inner surface 353 towards the drill string 310, wherein each guiding portion 359/360 defines at least one groove 361/362. The drill string 310 includes at least one sliding portion 363/364, each capable of sliding within one of the at least one groove 361/362 defined in the body 351 of the active stabilizer 350, to constrain relative movement between the drill string 310 and the active stabilizer 350 along an axial direction of the drill string 310 and guide relative movement between the drill string 310 and the active stabilizer 350 along a radial direction substantially perpendicular to the axial direction of the drill string 310. In some embodiments, the at least one sliding portion 363/364 projects outward from an outer surface of the drill string 310. In some embodiments, the sliding portion 363/364 is a sliding disk. In some embodiments, the groove 361/362 is an annular groove.

In some embodiments, the body 351 of the active stabilizer 350 includes an annular structure 365 having an outer diameter slightly smaller than the diameter of the borehole being drilled. An outer peripheral surface of the annular structure 365 contacts the borehole wall to help the actuators to push the drill bit away from the borehole center. In some embodiments, the annular structure 365 has opposite first and second axial ends 366 and 367, and the at least one guiding portion includes a first guiding portion 359 between the first axial end 366 of the annular structure 365 and the plurality of actuators 354 and a second guiding portion 360 between the second axial end 367 of the annular structure 365 and the plurality of actuators 354, along an axial direction of the annular structure.

The at least one guiding portion at the body 351 of the active stabilizer 350 and the at least one sliding portion at the drill string 310 coordinate with each other to guide the movement between the active stabilizer 350 and the drill string 310. By such a sliding mechanism, the motion and displacement of the active stabilizer can be accurately controlled, and undesired shaking and vibrations can be reduced.

There may be one or more measurement control modules and/or other devices, included in the rotary steerable system, for driving and controlling the plurality of actuators. For example, there may be a hydraulic system for driving the plurality of actuators, a measurement module for continuously measuring or estimating displacements of the plurality of actuators, a measurement module for continuously measuring a drilling direction of the drill bit during the drilling, and/or a controller for harmoniously controlling the plurality of actuators based on measurement or estimation of displacements of the plurality of actuators. In some embodiments, a measurement while drilling (MWD) module is used to continuously measure the bit position and directions (gesture), and the measurement results can be used to harmoniously control the hydraulic pistons to change the drilling direction to reach high drilling quality.

Figure 6:
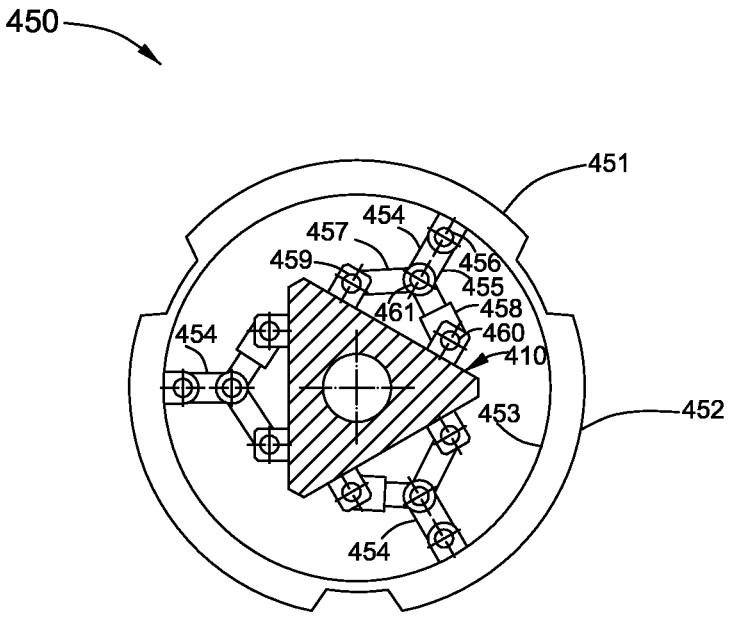
FIG. 6 is a schematic cross sectional view of an active stabilizer that can be used in a rotary steerable system like that of FIG. 1, in accordance with another embodiment of the present disclosure.

FIG. 6 illustrates another active stabilizer 450 that can be used in a rotary steerable system like the system 100 of FIG. 1. Similar to the active stabilizer 350, the active stabilizer 450 includes a body 451 having an outer surface 452 for contacting a wall of a borehole being drilled and an inner surface 453 facing a drill string 410, and a plurality of actuators 454 connecting the body 451 and the drill string 410.

Each of the actuators 454 includes a first link element 455 rotatably coupled to the body 451 via a first pivot joint 456, a second link element 457 and a third link element 458 rotatably coupled to the drill string 410 via a second pivot joint 459 and a third pivot joint 460, respectively. The first, second and third link elements 455, 457, 458 are connected via a fourth pivot joint 461. The third and fourth pivot joints 460, 461 are movable towards each other or away from each other. In some embodiments, the third link element 458 includes a cylinder and a piston movable within the cylinder. The plurality of actuators 454 are capable of driving the drill string 410 to deviate away from the borehole center with a displacement and stabilizing the drill string 410 against radial shaking during the drilling. By continuously and harmoniously controlling the plurality of actuators 454 to drive the drill string 310 to deviate away, the drilling direction can be changed according to a predetermined trajectory.

Similar to the active stabilizer 350, the active stabilizer 450 also has a sliding mechanism including at least one guiding portion at the body 451 of the active stabilizer 450 and at least one sliding portion at the drill string 410, which coordinate with each other to guide the movement between the active stabilizer 450 and the drill string 410. The specific implementation way of the sliding mechanism may be the same as that in the active stabilizer 350, and therefore will not be repeated.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A drilling system, comprising:

a rotatable drill string for connecting with a drill bit for drilling a borehole;

at least one fixed stabilizer fixed on the drill string and having an outer surface for contacting a wall of the borehole; and an active stabilizer comprising:

a body having an outer surface for contacting a wall of the borehole, an inner surface facing the drill string, and at least one guiding portion projecting from the inner surface towards the drill string, the at least one guiding portion defining, in part, a groove; and a plurality of actuators connecting the body and the drill string, the plurality of actuators capable of driving the drill string to deviate away from a center of the borehole with a displacement, wherein the drill string comprises at least one sliding portion capable of sliding within the groove defined in the body of the active stabilizer, to constrain relative movement between the drill string and the active stabilizer along an axial direction of the drill string and guide relative movement between the drill string and the active stabilizer along a radial direction substantially perpendicular to the axial direction of the drill string.

2. The system according to claim 1, wherein each of the actuators comprises a cylinder rotatably coupled to one of the drill string and the body of the active stabilizer and a piston rotatably coupled to the other of the drill string and the body of the active stabilizer, the piston movable within the cylinder.

3. The system according to claim 1, wherein each of the plurality of actuators comprises a first link element rotatably coupled to the body of the active stabilizer via a first joint, a second link element and a third link element rotatably coupled to the drill string via a second joint and a third joint, respectively, wherein the first, second and third link element are connected via a fourth joint, and the third and fourth joints are movable towards each other or away from each other.

4. The system according to claim 3, wherein the third link element comprises a cylinder and a piston movable within the cylinder.

5. The system according to claim 1, wherein the body of the active stabilizer comprises an annular structure having opposite first and second axial ends, and the at least one guiding portion comprises a first guiding portion between the first axial end of the annular structure and the plurality of actuators and a second guiding portion between the second axial end of the annular structure and the plurality of actuators, along an axial direction of the annular structure.

6. The system according to claim 1, wherein the at least one sliding portion projects outward from an outer surface of the drill string.

7. The system according to claim 1, wherein a maximum diameter of the active stabilizer is slightly smaller than a diameter of the borehole.

8. The system according to claim 1, further comprising a hydraulic system for driving the plurality of actuators.

9. The system according to claim 1, further comprising a controller for controlling the plurality of actuators based on a measurement or estimation of displacements of the plurality of actuators.

10. The system according to claim 1, further comprising a measurement module for continuously measuring a drilling direction of the drill bit during the drilling, to control the drilling direction.

11. The system according to claim 1, wherein the active stabilizer and the fixed stabilizer are connected through a flexible structure.

* * * * *